United States Patent [19]

Gamblin

[11] Patent Number: 5,029,760

[45] Date of Patent: Jul. 9, 1991

[54] CENTRIFUGAL GRINDING AND MIXING APPARATUS

[76] Inventor: Rodger L. Gamblin, 8 Springhouse Rd., Dayton, Ohio 45409

[21] Appl. No.: 427,815

[22] Filed: Oct. 26, 1989

[51] Int. Cl.[5] ..... B02C 17/08

[52] U.S. Cl. ..... 241/65; 241/137; 241/178; 241/179

[58] Field of Search ..... 241/176, 177, 178, 179, 241/175, 65, 66, 67, 137, 153; 51/164.2, 164.1, 163.1, 163.2

[56] References Cited

U.S. PATENT DOCUMENTS

| | | | |
|---|---|---|---|
| 405,810 | 6/1889 | Wegmann . | |
| 458,662 | 9/1891 | Pendleton . | |
| 569,828 | 10/1896 | Herzfeld . | |
| 1,144,272 | 6/1915 | West . | |
| 1,951,823 | 3/1934 | Eppers . | |
| 2,209,344 | 7/1940 | Matthews . | |
| 2,387,095 | 10/1945 | Shideler et al. . | |
| 2,874,911 | 2/1959 | Limb . | |
| 2,937,814 | 5/1960 | Joisel . | |
| 3,190,568 | 6/1965 | Freedman et al. . | |
| 3,311,310 | 3/1967 | Engels et al. | 241/153 |
| 3,513,604 | 5/1970 | Matsunaga et al. . | |
| 3,529,780 | 9/1970 | Wilkinson, Jr. . | |
| 3,876,160 | 4/1975 | Bloch . | |
| 4,057,191 | 11/1977 | Ohno . | |

FOREIGN PATENT DOCUMENTS

| | | | |
|---|---|---|---|
| 1089428 | 11/1980 | Canada . | |
| 260777 | 2/1912 | Fed. Rep. of Germany . | |
| 1097790 | 1/1961 | Fed. Rep. of Germany . | |
| 2200643 | 7/1973 | Fed. Rep. of Germany | 241/178 |
| 2624945 | 12/1977 | Fed. Rep. of Germany | 241/176 |
| 1088571 | 3/1955 | France . | |
| 593777 | 10/1947 | United Kingdom . | |

*Primary Examiner*—Mark Rosenbaum

*Attorney, Agent, or Firm*—Wood, Herron & Evans

[57] ABSTRACT

A centrifugal mill adapted for the continuous grinding of granulated material into fine powder is disclosed. At least one pair of grinding chambers is provided. The grinding chambers are rotated about their own axes one revolution in the opposite direction to the orbiting direction for each orbit and the orbiting radius is about 1.2 to about 4.0 times the grinding chamber radius. Under these conditions the grinding chambers do not rotate relative to the machine base so that communication with the grinding chamber and any surrounding jacket may be made through flexible hoses or tubes thereby avoiding the need for rotating seals. If desired, the grinding chamber may be subjected to atmospheres of controlled temperature, pressure and composition. As the grinding chamber atmosphere is isolated from the ambient atmosphere, contamination is avoided.

29 Claims, 4 Drawing Sheets

FIG. 1
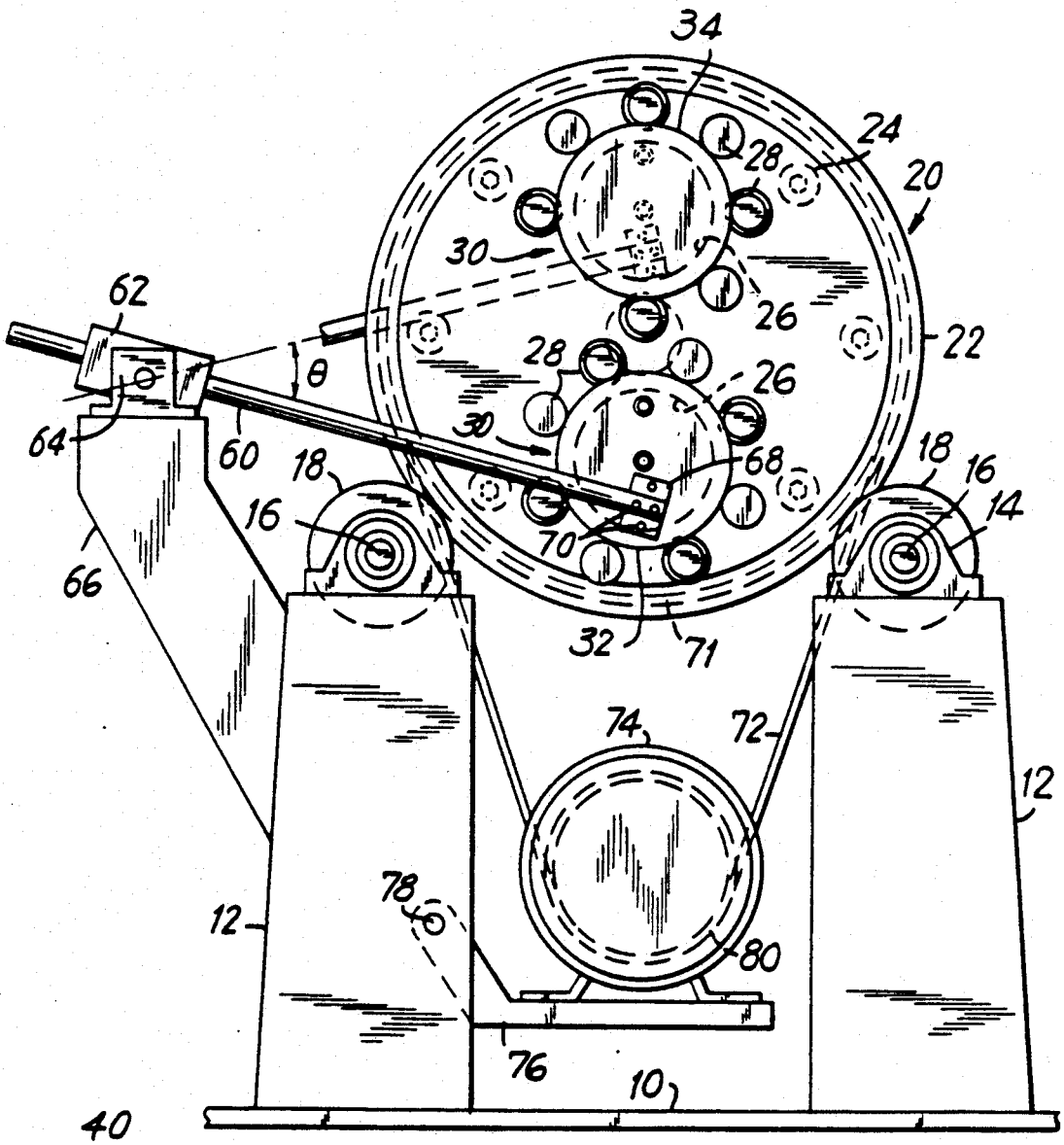
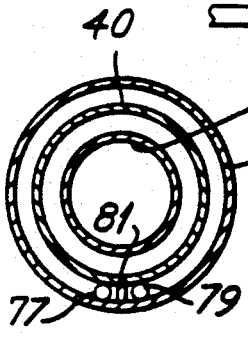
FIG. 2

CENTRIFUGAL GRINDING AND MIXING APPARATUS

BACKGROUND OF THE INVENTION

1. Field of the Invention

This invention relates to the field of grinding or comminution and dispersion and more particularly to the reduction of solid matter into fine particles.

The reduction of solid matter into fine particles is a necessary part of a number of industrial processes where the goal may be for a finely powdered material, a homogeneous mixture of finely powdered materials or dispersion of a finely powdered material or mixture of materials in a liquid phase. Paints may comprise a finely powdered pigment, such as titanium dioxide dispersed in an alkyd or latex system while inks may comprise a finely powdered brilliantly colored organic or inorganic pigment dispersed in oil or water vehicles. Ceramic materials comprise mixtures of finely ground silicates and aluminates. It has been found that the toughness and strength of the ultimate ceramic material is a function of the particle size to which the silicates and aluminates have been reduced.

Other examples occur in the field of powder metallurgy where it is important to reduce the metallic components to a very fine powder. In the food industry vegetable matter such as wheat, corn or rye is reduced to a fine powder to form flour, starch or a powder dispersion.

2. Description of the Prior Art

The primary crushing and grinding art is well developed but not of particular concern here where the object is to reduce granulated solid material to very fine powders. One of the oldest and simplest devices for fine grinding is the ball mill which normally comprises a cylindrical chamber which may be about 8 feet long and 4 feet in diameter and which is arranged to rotate about its axis. The axis of the cylinder is horizontal or slightly tilted and the chamber is filled about half full with steel or ceramic balls which may be, for example, about 3/16-⅜" in diameter. When the chamber is rotated at the proper speed, the balls cascade over one another to provide a grinding action between the balls and between the balls and the inside surface of the cylindrical chamber. Generally, the process is performed as a batch process over an extended period, such as 24 hours or more. While the ball mill is effective, it is relatively large and expensive and its throughput is slow so that the cost of the grinding process is relatively high.

The art has long endeavored to overcome certain of the deficiencies of the regular ball mill. One of these improvements is the so-called centrifugal or planetary mill in which the grinding chamber is orbited about an axis parallel to the axis of the grinding chamber. Wegmann U.S. Pat. No. 405,810 discloses an orbiting mill driven by planetary gears so as to produce centrifugal forces to aid in the grinding. While well adapted to a batch process the Wegmann device precludes direct attachment of input and output ducts. Another form of a centrifugal mill is disclosed in Pendleton U.S. Pat. No. 458,662. Due to the necessary supporting framework, the feed to the mill is required to pass through the machine axis by means of a rotating seal. A similar rotating seal feed is required by the Herzfeld U.S. Pat. No. 569,828 which discloses vertically oriented orbiting grinding chambers. West U.S. Pat. No. 1,144,272 describes a multiple grinding tube centrifugal mill having a planetary gear drive. Access to the grinding tubes is attained through doors 6 in the sides of the tubes thus permitting only a batch operating process. Eppers U.S. Pat. No. 1,951,823, like the Pendleton and Herzfeld patents noted above, discloses an axial feed with rotating seals for a centrifugal grinding mill.

Matthews U.S. Pat. No. 2,209,344 discloses a planetary rock crusher employing bars as the grinding media. Ore is fed into the mill at its axis and then circulated through the several planetary grinding chambers.

Shideler et al. U.S. Pat. No. 2,387,095 discloses a multiple tube centrifugal polishing or abrading machine equipped with a fixed eccentric to maintain the tubes in a fixed orientation relative to ground. The tubes are individually closed with stoppers to permit only a batch operation.

Limb U.S. Pat. No. 2,874,911 discloses a planetary centrifugal ball mill wherein the grinding chamber rotates more rapidly about its own axis then it does about its orbital axis, thereby limiting its operation to a batch process.

Joisel U.S. Pat. No. 2,937,814 discloses a planetary ball mill having two forms. The first form describes a discontinuous or batch process while the second form shows a continuous grinding process using rotary seals at the inlet and outlet. Separate motors are provided to drive the mixing chambers and to provide the orbital motion so that the relative speeds may be varied.

Matsunaga et al. U.S. Pat. No. 3,513,604 discloses a planetary polishing machine having a variable ratio of the orbital radius to the rotational radius so that the grinding chamber rotates relative to ground, thereby necessitating a batch process.

Wilkinson, Jr. U.S. Pat. No. 3,529,780 discloses a continuously fed planetary grinding mill having an intermittent discharge into a curved trough.

Bloch U.S. Pat. No. 3,876,160 discloses a centrifugal mill wherein the grinding chambers and orbital motion are separately controlled. Alternatively the grinding chamber axis may be parallel to the orbital axis, perpendicular to the orbital axis or varied respective to the radius of the planetary movement. However, in each alternative a batch operation is contemplated.

Freedman et al. U.S. Pat. No. 3,190,568 discloses a cell disintegrating apparatus for batch or continuous operation in which the disintegrating tube is rapidly oscillated in a direction perpendicular to its axis to shake and abrade cellular material.

Ohno U.S. Pat. No. 4,057,191 discloses a grinding mill having a grinding tube with one end mounted in a spherical bearing while the other end is moved in a circular path by a rotating crank so as to provide a hybrid form of a centrifugal mill.

German patent 260,777 (1913) discloses a planetary ball mill having a toroidally-shaped grinding chamber wherein the grinding chamber radius is significantly greater than the planetary or orbital motion radius. Both the feed and discharge are gravity controlled.

German patent 1,097,790 (1961) discloses a planetary crushing mill for granulated solid material suspended in a liquid wherein the rotation of the grinding chamber is independent of the planetary or orbital rotation thus requiring rotating seals at the inlet and outlet of the grinding chamber.

British patent 593,777 (1947) discloses a planetary grinding mill in which a spheroidal grinding chamber is orbited around a vertical axis and simultaneously oscillated about its own axis. The spheroidal grinding chamber is supported from one end in a pivoted bearing so that variations in the centrifugal force due to the quantity of material being ground can be used to control the feed rate to the grinding chamber.

Canadian patent 1,089,428 (1980) discloses a planetary grinding mill driven by a pair of eccentrics such that the orbiting radius is small compared with the grinding chamber radius so as to provide "a continuous operation in the sub-critical range at a high grinding rate per unit of volume of the grinding drum . . . " (page 1, 11. 22-23).

French patent 1,088,571 (1955) discloses a planetary grinding mill driven by pairs of counterbalanced cranks connected by a pair of crossarms to which one or more grinding chambers are affixed. As mechanical counterweights are utilized to balance each grinding chamber a dynamic balance would be difficult to attain.

SUMMARY OF THE INVENTION

In accordance with the present invention a planetary centrifugal mill is provided having one or more pairs of cylindrical grinding chambers arranged so that the ratio of the rotation of the grinding chamber about its own axis to the rotation about the orbital axis equals minus one. Moreover, to optimize the grinding action the ratio of the orbital radius to the grinding tube radius should be greater than one and preferably about 1.2 to 4.0 and more preferably between about 1.7 and 3.0. Under these conditions the mill may be dynamically balanced while operated either as a batch process or as a continuous process. In accordance with the present invention, a plurality of conduits may be connected to each grinding chamber including inlet and outlet feed conduits, additional feed conduits, inlet and outlet cooling conduits, inlet and outlet heating conduits, sensors, etc. Where the orbital paths of the grinding chambers have a common axis, two grinding chambers only may be employed and access to the grinding chambers may be made on one end only. However, where the orbiting axes of the grinding chambers are separated so that the grinding chambers do not rotate about each other, the service conduits may be located on either or both ends of the grinding chamber. In accordance with the present invention, the mill is capable of reducing relatively large chunks of material to fine powders and to disperse fine powders of different materials to provide a homogeneous mixture. The mill incorporates no rotating seals and is closed so that both the atmosphere within the mill and the pressure of that atmosphere may be controlled as may be desired.

DESCRIPTION OF THE DRAWINGS

Further objects and advantages of the invention will become apparent from the following detailed description of the invention and the accompanying drawings in which:

FIG. 1 is an end view of a centrifugal mill in accordance with the present invention having two cylindrical grinding chambers and adapted for continuous operation;

FIG. 2 is a fragmentary cross-sectional view of an alternative form of the grinding chamber of FIG. 1 which has a jacket;

DETAILED DESCRIPTION OF THE INVENTION

It has long been known that grinding of coarse material into a fine powder and homogeneous dispersion of the powdered particles can be obtained in a ball mill if the mill is operated for a sufficiently long period of time, e.g., 24 hours. Grinding results from the cascading of the balls against each other, the wall of the mill and the material to be ground. Cascading of the balls results from the fact that the rotation of the cylindrical grinding chamber and the viscosity of the material to be ground tends to carry the balls up the wall of the grinding chamber until the force of gravity causes the balls and material to be ground to flow. At high rotational speeds the centrifugal forces developed overcome the gravitational force and neither cascading nor grinding occurs. The grinding power of a ball mill, which determines its capacity, is directly related to its size.

However, if the grinding chamber is orbited about an axis parallel to its own axis and rotated about its own axis in the opposite direction at a rate of one rotation per orbit, the grinding chamber will maintain a fixed orientation with respect to the machine base but the grinding media will be affected as though the gravitational field were of a magnitude of $R_1W^2$ where $R_1$ is the orbiting radius and W is the angular speed in orbits or revolutions per minute. Within the grinding chamber the force felt by a particle traveling around the wall of the grinding chamber is proportional to $R_2W^2$ where $R_2$ is the radius of the grinding chamber in feet and W is the angular speed in orbits or revolutions per minute. For optimum grinding results it has been found that the ratio of the orbiting radius to the grinding chamber radius should be in the range of about 1.2 to 1 to about 4.0 to 1.

The grinding power (P) expended in a centrifugal or planetary mill is given by the formula:

$$P=3.057\times10^{-8}\,pLR_1R_2^3(rpm)^3$$

where:

P=grinding power in horsepower (HP)
p=density of the grinding media in lbs/ft$^3$
L=length of grinding tube in feet
$R_1$=orbiting radius in feet and
$R_2$=grinding tube radius in feet.

When the optimum ratio of about 2.15 is employed for the ratio of the orbiting radius to the grinding tube radius the formula reduces to:

$$P=1.747\times10^{-9}\,pLR_1^4(rmp)^3$$

The grinding power of a planetary mill having a single 5.6 inch diameter grinding chamber and a length of 2 feet orbiting at 1000 rpm on an orbital diameter of 1 foot and employing 1/16 inch diameter balls is about the same as that of a conventional ball mill 4 feet in diameter and 8 feet long rotated at 21 rpm and employing ⅜ inch diameter balls.

Figure 3:
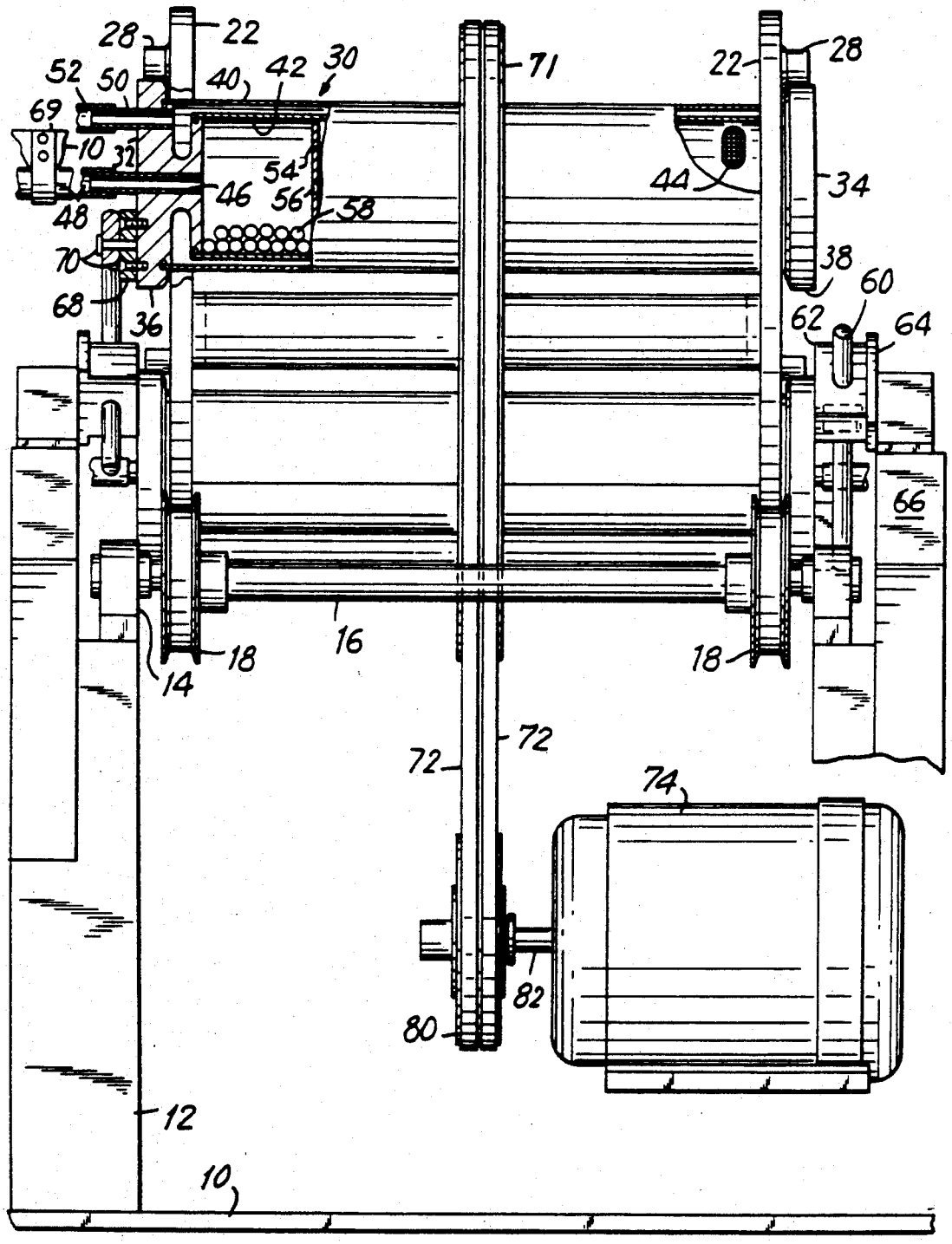
FIG. 3 is a side view partly in section of the centrifugal mill shown in FIG. 1.

Reference is now made to FIGS. 1 and 3 which represent a first embodiment of the invention employing a pair of dynamically balanced grinding chambers. The mill comprises a base 10 which carries four pedestals 12. A bearing 14 is mounted on the top of each pedestal 12 and an axle 16 is rotatably supported in the bearings 14. Each axle 16 also carries two flanged support wheels 18.

A rotatable drum assembly 20 is positioned to engage the flanged support wheels 18. The drum assembly 20 comprises a pair of apertured discs 22 which are interconnected by a plurality of tie rods 24 which space the apertured discs 22 so that discs 22 and the drum assembly are rotatably supported by the flanged support wheels 18. Two apertures 26 are symmetrically positioned along a diameter of each disc 22. A plurality of rollers 28 are mounted circumferentially about each aperture 26. Cylindrical grinding chambers 30 are provided with end caps 32, 34. The end caps 32, 34 each have circular outer rims 36, 38 which make rolling contact with the rollers 28. The grinding chamber 30 also includes at least an outer tubular member 40 which is attached at each end to the end caps 32, 34. Preferably, the grinding chamber will also include an inner tubular member 42 attached at each end to the end caps 32, 34 and having screened openings 44 formed in the end adjacent to end cap 34. A feed nipple 46 communicates through end caps 32, preferably along the axis thereof, and a flexible feed tube 48 is attached to the outer end of the feed nipple. A discharge nipple 50 communicates through end cap 32 to the region between outer tubular member 40 and inner tubular member 42. A flexible discharge tube 52 is attached to the open end of the discharge nipple 50. If desired, one or more dividing plates 54 having a central orifice 56 may be affixed to the inner tubular member 42 so as to define a series of grinding zones within the grinding chamber 30. Appropriately sized grinding balls 58 are located within the grinding chamber 30. Where the grinding chamber is divided into zones, it may be desired to employ grinding balls of a different size or material in each zone. Generally, the larger grinding balls will be used in the zone adjacent the feed nipple 46.

It will be appreciated that the material to be ground enters the grinding chamber 30 through the feed nipple 46, passes sequentially through the grinding zones, leaves the first grinding zone through the screened openings 44, passes along the outside of the inner tubular member 42 and exits the grinding chamber 30 through the discharge nipple 50.

During operation of the mill it is essential that, relative to the mill base 10 and pedestals 12, the grinding chamber 30 not rotate although oscillation may be tolerated. To accomplish this purpose, a bar 60 is mounted for axial reciprocating and oscillating motion in a pivoted block 62 mounted in a bearing 64 affixed to a support arm 66 which, in turn, is fastened to one of the pedestals 12. One end of the bar 60 is rigidly attached to the end cap 32 through a spacer 68 and appropriate fasteners 70. It will be seen that as the drum assembly 20 rotates about its axis, the bar 60 will oscillate through an angle $\Theta$ as indicated on FIG. 1. Since the end plate 32 of the grinding chamber 30 is rigidly fastened to the bar 60, the grinding chamber 30 will similarly oscillate through an angle $\Theta$ as the drum assembly 20 rotates. While the angle $\Theta$ is not critical it can be minimized by aligning the bar 60 with a radius of the end cap 32 and increasing the distance between the axis of the drum assembly 20 and the pivot point of the pivoted block 62. It will be understood that each grinding chamber 30 is provided with a bar 60 and pivoted block assembly 62.

The bar and pivoting block assembly described above is effective to positively eliminate rotation of the grinding chamber 30 relative to the base 10. However, where the grinding chamber 30 is mounted on rollers 28 the torque tending to rotate the grinding chamber 30 may be relatively small and capable of being resisted by the flexible tube 48. In this event, the flexible tube 48 may be affixed to the base 10 by an appropriate clamp 69 and rotation of the grinding chamber 30 relative to the base eliminated so that the grinding chamber has a pure orbital motion. It will be understood, of course, that the additional flexible tube 52 may be similarly clamped against rotation or clamped to tube 48 so long as sufficient flexibility is maintained to accommodate the required orbital motion of the grinding chamber.

A pulley 71 is mounted on the several tie rods 24 intermediate the apertured discs 22 and may comprise several sheaves adapted to receive multiple belts 72. Preferably, the belts 72 will be standard Vee belts. A drive motor 74 is mounted on a support 76 which is pivotally connected by a pin 78 to one or more of the pedestals 12. A drive pulley 80 is keyed to the motor drive shaft 82 and carries the belts 72. It will be appreciated that the weight of the motor 74 serves to tension the belts 72 and to assist in maintaining the drum assembly 20 in contact with the support wheels 18.

In operation, the grinding chambers 30 are charged with an appropriate quantity of grinding balls 58 and the material to be ground is introduced into the grinding chambers 30 through the flexible tubes 48. When the motor 74 rotates the drum assembly 20, the grinding chambers 30 will have an orbital or planetary motion. Since the grinding chambers 30 are symmetrically disposed with respect to the axis of the drum assembly 20, and are charged with the same quantity of grinding balls and granular material, the mill will be substantially dynamically balanced and can be operated continuously. If desired, the grinding chambers 30 may be subdivided along their axes so that the granulated material may be ground by different sizes of grinding balls as it progresses axially through the chamber. Since the chambers 30 do not rotate with respect to the base 10 of the mill, any desired number of connections may be made through the end cap 32. Such additional connections may be provided in order to provide or control the nature of the atmosphere within the grinding chamber or its pressure or other physical attribute (referred to as "environmental control"). If desired, a jacket 75 (FIG. 2) may be provided around the grinding chamber 30 for the introduction of steam or water for heating or cooling the grinding chamber. Water or steam may enter the jacket at 77 and leave the jacket at 79. The water flow can be controlled by an appropriate baffle 81.

Figure 4:
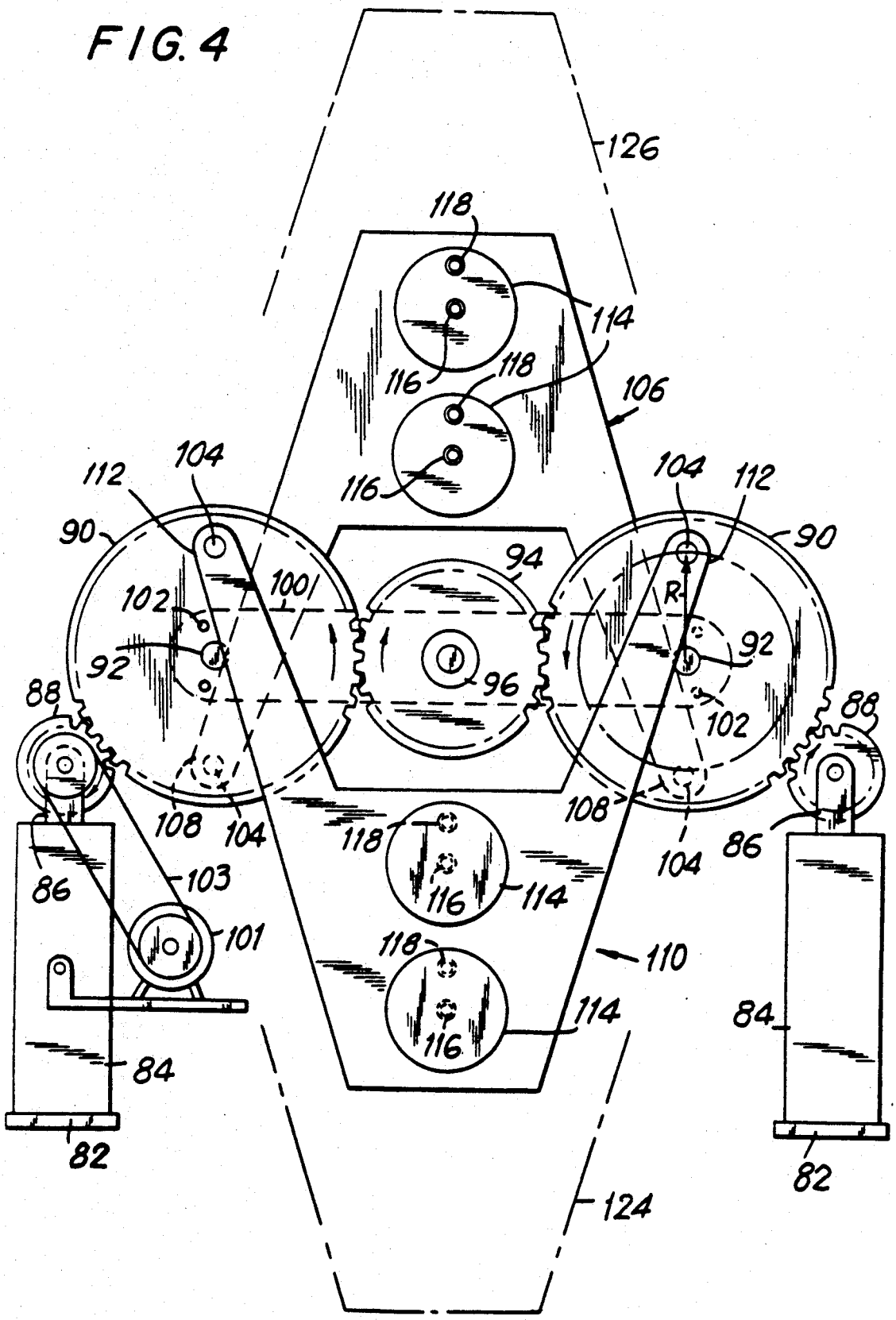
FIG. 4 is an end view of an alternative form of a centrifugal mill in accordance with the present invention having multiple pairs of cylindrical grinding chambers and adapted for continuous operation.
Figure 6:
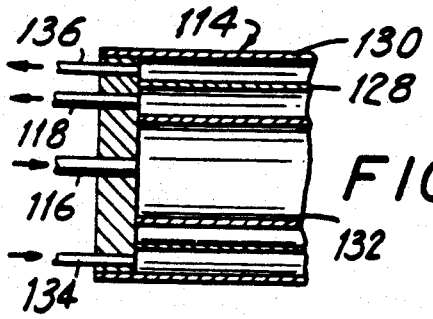
FIG. 6 is a fragmentary longitudinal view of an alternative form of the grinding chamber shown in FIG. 5 which has a jacket.
Figure 5:
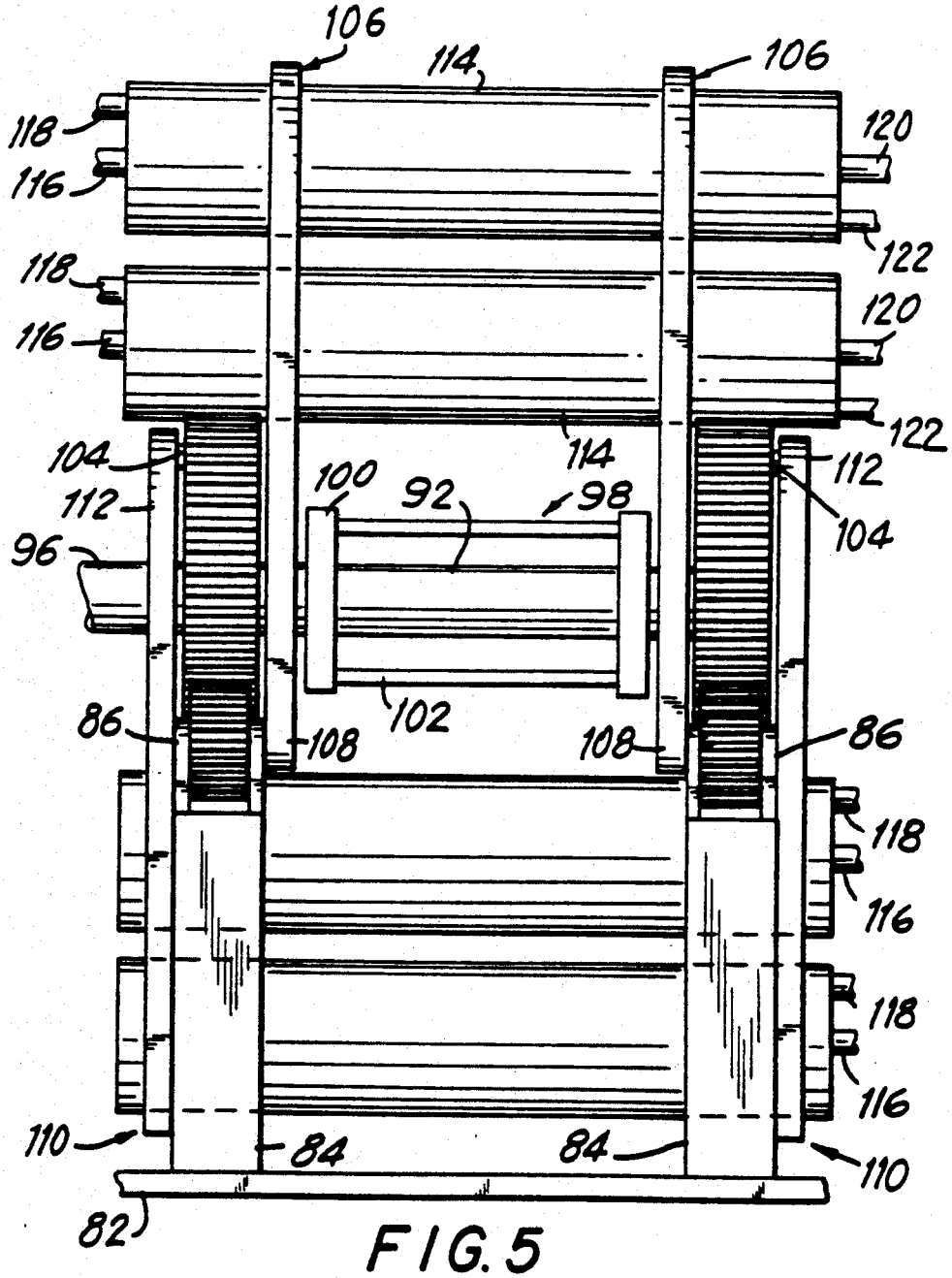
FIG. 5 is a side view of the centrifugal mill shown in FIG. 3.

FIGS. 4, 5 and 6 illustrate a second embodiment of a centrifugal mill in accordance with the present invention. In this form of the invention, the grinding chambers do not rotate about each other and therefore any number of grinding chambers can be provided while still employing ingress and egress conduits for each grinding chamber. Referring now to FIGS. 4 and 5, the mill base is designated 82 and supports four pedestals 84 which carry journals 86. Support pinions 88 are rotatably mounted on the journals 86. Two pairs of drive gears 90 interconnected by shafts 92 mesh with the support pinions 88 and the central gears 94. The central gears 94 are journalled on or keyed to a control shaft 96. To maintain the alignment of the drive gears 90 and the central gears 94, the shafts 92 and 96 may be journalled in a cage 98 formed from a pair of journal bars 100 spaced by a plurality of tie rods 102. It will be understood that the mechanism may be driven by driving one or more of the support pinions 88 through a suitable motor 101 and belt or gear drive 103. Alternatively, the central shaft 96 may be driven by an appropriate motor and belt or gear drive.

Each drive gear 90 is fitted with a pair of studs 104 located along a diameter of the gear 90 but disposed on opposite sides of the gear. Two upper support frames 106 having leg sections 108 are carried on the studs 104 mounted on the inner sides of the drive gears 90. Similarly, two lower support frames 110 having leg sections 112 are carried on the studs 104 mounted on the outer sides of the drive gears 90. Grinding chambers 114 are carried by the pairs of upper and lower support frames. The grinding chambers 114 may be similar to the grinding chambers 30 described above and have any desired number of inlets 116 and outlets 118. However, since the grinding chambers 114 do not rotate about each other, additional inlets 120 and outlets 122 may be located on the opposite end of the grinding chamber. Of course, if desired, the inlet for the material to be ground may be on one end of the grinding chamber 114 and the outlet on the other end. Similarly, where a fluid jacket 128, 130 is provided around the grinding chamber to accommodate heating or cooling, fluids may enter the cooling jacket at 134 and leave the jacket at 136 as shown in FIG. 6. The flow of material being ground along the axis of the grinding chamber may be either co-current or counter-current with respect to the heating or cooling fluids.

It will be seen by reference to FIG. 4 that the drive gears 90 rotate in the same direction and at the same angular velocity so that the studs 104 rotate in a circle having a radius R. Due to this arrangement, every point in the lower support frame 110 rotates in a circle having a radius R. The uppermost position of the lower support frame 110 is shown in the solid lines while the lowermost position is shown by the phantom line 124. Similarly every point in the upper support frame 106 moves in a circle having a radius R from a lowermost position shown in solid lines to an uppermost position indicated by the phantom line 126. As the upper support frame 106 and the lower support frame 110 move inwardly or outwardly in synchronism, the mill remains in substantial dynamic balance provided that the amount of material to be ground which is introduced into each grinding chamber 114 remains constant.

In order to optimize the grinding action, it has been found that the ratio of the planetary radius, i.e., the radius R to the grinding tube radius should be about 2.15 to 1 although it can vary, for example, in the range of about 1.2:1 to about 4.0:1. In accordance with the present invention, a mill employing two 5.6" diameter ×2 feet long grinding chambers orbited on a 12" diameter at about 1000 orbits per minute will consume about twice the energy and produce twice the throughput of a conventional ball mill having a diameter of about 4 feet and a length of 8 feet. In addition, no rotating seals are required so that no dust can escape and the internal atmosphere can be controlled while operating in a continuous manner. If desired, the residence time can be increased and the throughput decreased by sequentially passing the material to be ground from a first grinding chamber to a second grinding chamber.

As the grinding chambers are relatively small and relatively inexpensive, the inside walls may be lined or coated with anticorrosive or antierosive materials or materials otherwise particularly suited for the grinding function to be performed. The grinding media are preferably steel or ceramic balls which may be fairly small, i.e., less than 174 " in diameter and usually about 1/16" in diameter. As both the size of the grinding balls and the weight of the balls is far less than the equivalent required in a conventional ball mill, the grinding media also become relatively inexpensive. In general, as with a conventional ball mill, the material to be ground plus the grinding media occupy about half the volume of the grinding chamber. The grinding action may be adjusted by controlling the orbital speed of the mill.

The terms and expressions which have been employed are used as terms of description and not of limitation and there is no intention in the use of such terms and expressions of excluding any equivalent of the features shown and described or portions thereof, but it is recognized that various modifications are possible within the scope of the invention claimed.

What is claimed is:

1. A centrifugal grinding mill comprising a base, a rotatable drum assembly supported on said base for rotation about a central substantially horizontal axis, said drum assembly including a pair of cylindrical grinding chambers having axes parallel to that of said rotatable drum assembly, said chambers being mounted in said drum assembly for rotation, relative to the drum assembly, about their respective said axes, said grinding chambers moving along orbital paths about said central axis as said drum assembly is rotated, means for limiting rotation of said cylindrical grinding chambers about their respective said axes while allowing rotation of the drum assembly about the drum assembly axis, and driving means supported by said base and drivingly interconnected with said rotatable drum assembly, the positions at which said drum assembly is supported on said base and interconnected with said driving means being radially outward of said orbital paths of movement of said grinding chambers, whereby the grinding chambers can be continuously fed and operated without the use of relatively rotating connections.

2. A centrifugal grinding mill as described in claim 1 wherein said means for limiting rotation of said cylindrical grinding chambers comprise a bar affixed at a first end to each said cylindrical grinding chamber and a bushing pivotally mounted on said base and slidably connected to said bar adjacent the second end of said bar.

3. A centrifugal grinding mill as described in claim 2 wherein each grinding chamber has a bar for limiting rotation attached to one end of it, the bars of the respective chambers being at opposite ends of the drum assembly so as not to interfere with one another.

4. A centrifugal mill as described in claim 1 or claim 2 wherein the radial distance from said central axis to the axis of each cylindrical grinding chamber is in the range of about 1.2 to about 4.0 times the radius of said cylindrical grinding chamber.

5. A centrifugal mill as described in claim 1 wherein said drum assembly comprises a pair of apertured discs and said base comprises a plurality of support wheels disposed to engage and support said apertured discs.

6. A centrifugal grinding mill as described in claim 1 wherein said drum assembly comprises a pair of axially spaced apertured discs and said grinding chambers are journaled for rotation in the apertures of said discs.

7. A centrifugal mill as described in claim 6 wherein said driving means is an electric motor pivotally supported on said base and interconnected with said drum by at least one belt which engages the periphery of the drum assembly.

8. A centrifugal mill as described in claim 1 in which each said cylindrical grinding chamber is provided with at least one feed port and one discharge port which can be attached to feed and discharge tubes by non-rotating seals, said ports being radially inward of the said positions at which said drum assembly is supported and driven.

9. A centrifugal mill as described in claim 8 in which each said cylindrical grinding chamber is further provided with an environment control jacket and at least one inlet and outlet nipple which can be attached to inlet and outlet tubes by non-rotating seals.

10. A centrifugal grinding mill as described in claim 1 wherein said driving means engages the periphery of said drum assembly.

11. A centrifugal grinding mill as described in claim 6 wherein said drum assembly is supported on said base for rotation by wheels which engage the peripheries of said apertured discs.

12. A centrifugal grinding mill comprising a base, a plurality of drive gears rotatably supported by said base for synchronous rotation, a pair of upper support frames, each upper support frame pivotally connected to two of said drive gears at corresponding positions on a first side of said drive gears, a pair of lower support frames, each lower support frame pivotally connected to two of said drive gears at corresponding positions on a second side of said drive gears which positions are diametrically opposed to said corresponding positions on said first side of said drive gears whereby each support frame is constrained to move in an orbit, at least one horizontally disposed cylindrical grinding chamber carried by said pair of upper support frames, at least one horizontally disposed cylindrical grinding chamber carried by said pair of lower support frames, and driving means interconnected with said drive gears.

13. A centrifugal mill as described in claim 12 wherein two cylindrical grinding chambers are carried by said pair of upper support frames and two cylindrical grinding chambers are carried by said pair of lower support frames.

14. A centrifugal mill as described in claim 13 wherein the orbiting radius of the axes of said cylindrical grinding chambers is in the range of about 1.2 to about 4.0 times the radius of said cylindrical grinding chambers.

15. A centrifugal mill as described in claim 13 in which each said cylindrical grinding chamber is provided with at least one feed tube and one discharge tube.

16. A centrifugal mill as described in claim 15 in which each said cylindrical grinding chamber is provided with a water jacket and an inlet tube and an outlet tube therefor.

17. A centrifugal mill as described in claim 15 in which the said feed and discharge tubes are disposed on opposite ends of the cylindrical grinding chambers.

18. A centrifugal mill as described in claim 17 in which the discharge tube from one said cylindrical grinding chamber carried by said pair of upper support frames communicates with the feed tube of the other said cylindrical grinding chamber carried by said pair of upper support frames and the discharge tube from one said cylindrical grinding chamber carried by said pair of lower support frames communicates with the feed tube of the other said cylindrical grinding chamber carried by said pair of lower support frames.

19. A centrifugal mill as described in claim 15 in which each said cylindrical grinding chamber is provided with a steam jacket and an inlet tube and an outlet tube therefor.

20. A centrifugal mill as described in claim 14 in which each said cylindrical grinding chamber is provided with at least one feed tube and one discharge tube.

21. A centrifugal mill as described in claim 20 in which each said cylindrical grinding chamber is further provided with a water jacket and an inlet tube and an outlet tube therefor.

22. A centrifugal mill as described in claim 20 in which each said cylindrical grinding chamber is further provided with a steam jacket and an inlet tube and an outlet tube therefor.

23. A centrifugal mill as described in claim 12 wherein the orbiting radius of the axes of said cylindrical grinding chambers is in the range of about 1.2 to about 4.0 times the radius of said cylindrical grinding chambers.

24. A centrifugal mill as described in claim 23 in which each said cylindrical grinding chamber is provided with at least one feed tube and one discharge tube.

25. A centrifugal mill as described in claim 24 in which each said cylindrical grinding chamber is further provided with a water jacket and an inlet tube and an outlet tube therefor.

26. A centrifugal mill as described in claim 24 in which each said cylindrical grinding chamber is further provided with a steam jacket and an inlet tube and an outlet tube therefor.

27. A centrifugal mill as described in claim 12 in which each said cylindrical grinding chamber is provided with at least one feed tube and one discharge tube.

28. A centrifugal mill as described in claim 27 in which each said cylindrical grinding chamber is provided with a water jacket and an inlet tube and an outlet tube therefor.

29. A centrifugal mill as described in claim 27 in which each said cylindrical grinding chamber is provided with a steam jacket and an inlet tube and an outlet tube therefor.

* * * * *